US008864475B2

(12) United States Patent
Bensley

(10) Patent No.: US 8,864,475 B2
(45) Date of Patent: Oct. 21, 2014

(54) PUMP WITH WASH FLOW PATH FOR WASHING DISPLACEMENT PISTON AND SEAL

(75) Inventor: Douglas S. Bensley, Proctorsville, VT (US)

(73) Assignee: Ivek Corporation, North Springfield, VT (US)

( * ) Notice: Subject to any disclaimer, the term of this patent is extended or adjusted under 35 U.S.C. 154(b) by 815 days.

(21) Appl. No.: 12/790,098

(22) Filed: May 28, 2010

(65) Prior Publication Data

US 2010/0301069 A1 Dec. 2, 2010

Related U.S. Application Data

(60) Provisional application No. 61/181,959, filed on May 28, 2009.

(51) Int. Cl.

| | |
|---|---|
| ***B67D 7/06*** | (2010.01) |
| ***B67D 7/58*** | (2010.01) |
| ***F04B 53/14*** | (2006.01) |
| ***F04B 53/16*** | (2006.01) |

(52) U.S. Cl.

CPC ..... *F04B 53/16* (2013.01); *F04B 53/14* (2013.01); *F05C 2225/00* (2013.01); *F05C 2203/08* (2013.01)

USPC ..... 417/313; 417/434; 417/440; 417/571; 92/169.1; 92/78; 92/87

(58) Field of Classification Search

CPC ..... F04B 53/008; F04B 53/14; F04B 53/16; F04B 53/162

USPC ..... 417/53, 313, 440, 461, 469, 434, 571, 417/567, 495; 92/169, 153, 87, 78, 781; 277/408, 512, 515, 514

See application file for complete search history.

(56) References Cited

U.S. PATENT DOCUMENTS

| | | | | |
|---|---|---|---|---|
| 2,276,225 | A | | 3/1942 | Carter |
| 2,771,880 | A | | 11/1956 | Gotthart |
| 2,970,021 | A | | 1/1961 | Glaser et al. |
| 3,182,599 | A | | 5/1965 | Blakeslee |
| 3,511,512 | A | | 5/1970 | Wheelock |
| 4,233,886 | A | * | 11/1980 | Balzano et al. ..... 92/86.5 |
| 4,691,620 | A | * | 9/1987 | Kao ..... 92/80 |
| 4,822,059 | A | | 4/1989 | Shimasaki et al. |
| 4,941,809 | A | | 7/1990 | Pinkerton |
| 5,015,157 | A | | 5/1991 | Pinkerton et al. |
| 5,020,980 | A | | 6/1991 | Pinkerton |
| 5,044,889 | A | | 9/1991 | Pinkerton |
| 5,092,037 | A | | 3/1992 | Pinkerton |

(Continued)

FOREIGN PATENT DOCUMENTS

WO WO 2007000189 A1 * 1/2007

*Primary Examiner* — Peter J Bertheaud
*Assistant Examiner* — Dominick L Plakkoottam
(74) *Attorney, Agent, or Firm* — Grossman Tucker Perreault & Pfleger, PLLC

(57) ABSTRACT

In general, a piston-type pump includes a wash flow path that allows a wash liquid such as water to pass through to provide washing and cleaning as the pump operates. The pump may be used in precision liquid dispensing systems and particularly with liquid solutions that have a tendency to precipitate solid particulate. By washing a portion of the pump piston, the liquid solution being dispensed and any solid particulates may be carried away and removed from the pump.

12 Claims, 4 Drawing Sheets

(56) References Cited

U.S. PATENT DOCUMENTS

| | | | | |
|---|---|---|---|---|
| 5,209,502 | A | 5/1993 | Savoia | |
| 5,472,320 | A * | 12/1995 | Weisbrodt | 417/326 |
| 5,921,555 | A | 7/1999 | Johnston | |
| 5,938,416 | A * | 8/1999 | Saito et al. | 417/521 |
| 5,941,533 | A | 8/1999 | Jacobsen et al. | |
| 6,095,780 | A | 8/2000 | Ernens | |
| 6,224,347 | B1 * | 5/2001 | Clark et al. | 417/222.1 |
| 6,302,662 | B1 * | 10/2001 | Bensley et al. | 417/519 |
| 6,322,337 | B1 | 11/2001 | Bensley et al. | |
| 6,409,175 | B1 | 6/2002 | Evans et al. | |
| 6,428,013 | B1 | 8/2002 | Johnston et al. | |
| 7,080,975 | B2 | 7/2006 | Besse et al. | |
| 7,214,039 | B2 | 5/2007 | Angove | |
| 7,217,105 | B2 | 5/2007 | Angove | |
| 2004/0241023 | A1 | 12/2004 | Pinkerton, III et al. | |
| 2005/0194407 | A1 * | 9/2005 | Bach | 222/309 |
| 2005/0276705 | A1 * | 12/2005 | Pinkerton et al. | 417/415 |
| 2007/0256556 | A1 * | 11/2007 | Rawlings | 92/165 R |

* cited by examiner

PUMP WITH WASH FLOW PATH FOR WASHING DISPLACEMENT PISTON AND SEAL

RELATED APPLICATIONS

The present application claims the benefit of U.S. Provisional Application Ser. No. 61/181,959 filed May 28, 2009, which is herein incorporated by reference.

TECHNICAL FIELD

The present disclosure relates to pumps for use in liquid dispensing in precise volumes and more particularly, to a pump with a wash flow path for washing a displacement piston and seal.

BACKGROUND INFORMATION

Displacement pumps may be used to dispense liquids in precise volumes. One type of displacement pump may include a ceramic displacement piston that reciprocates within a pump chamber in a ceramic cylinder to cause liquid to be drawn in and expelled from the pump while a valve piston rotates between one or more inlets and one or more outlets. In such pumps, the pump chamber may be primarily sealed by a tight fit between the displacement piston and the cylinder.

In certain applications, the liquid being dispensed may include solids in solution and the solid may precipitate from the solution causing problems. In certain medical applications, for example, EDTA/salt solutions may be dispensed and salt crystals may be formed when the solution migrates from the pump chamber and dries. The salt crystals may cause contamination of the pumping area and/or may cause the pumps to seize. Although pumps have been provided with washing features, such existing pumps may not adequately wash the piston and seals, particularly where a tight fit is used to seal the piston and cylinder.

BRIEF DESCRIPTION OF THE DRAWINGS

These and other features and advantages will be better understood by reading the following detailed description, taken together with the drawings wherein.

DETAILED DESCRIPTION

In general, a piston-type pump, consistent with embodiments of the present disclosure, includes a wash flow path that allows a wash liquid such as water to pass through to provide washing and cleaning as the pump operates. The pump may be used in precision liquid dispensing systems and particularly with liquid solutions that have a tendency to precipitate solid particulate. By washing a portion of the pump piston, the liquid solution being dispensed and any solid particulates may be carried away and removed from the pump.

Figure 1:
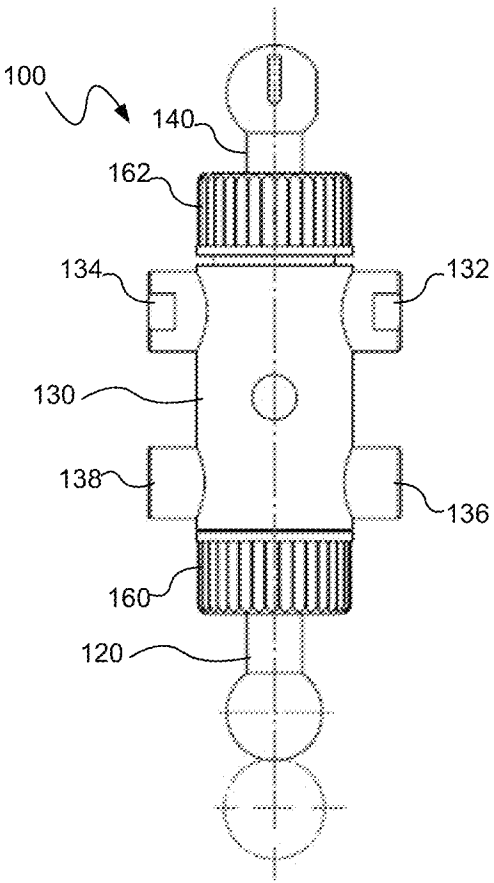
FIG. 1 is a front view of a pump with a wash flow path, consistent with an embodiment.
Figure 2:
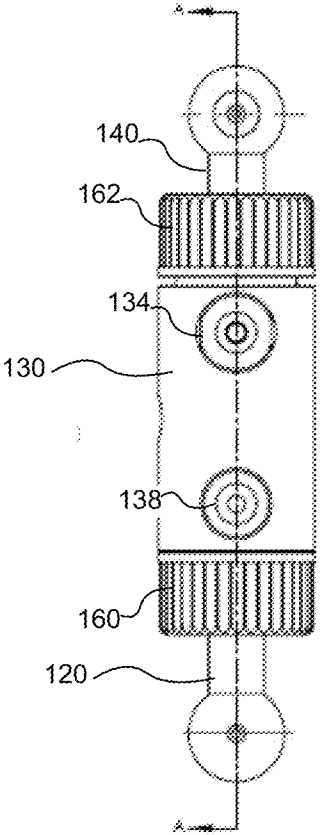
FIG. 2 is a side view of the pump shown in FIG. 1.
Figure 3:
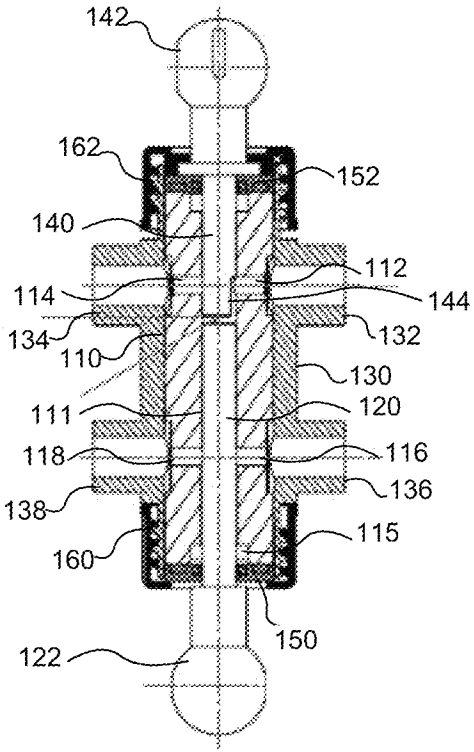
FIG. 3 is a cross-sectional view of the pump taken along the line A-A in FIG. 2.
Figure 4:
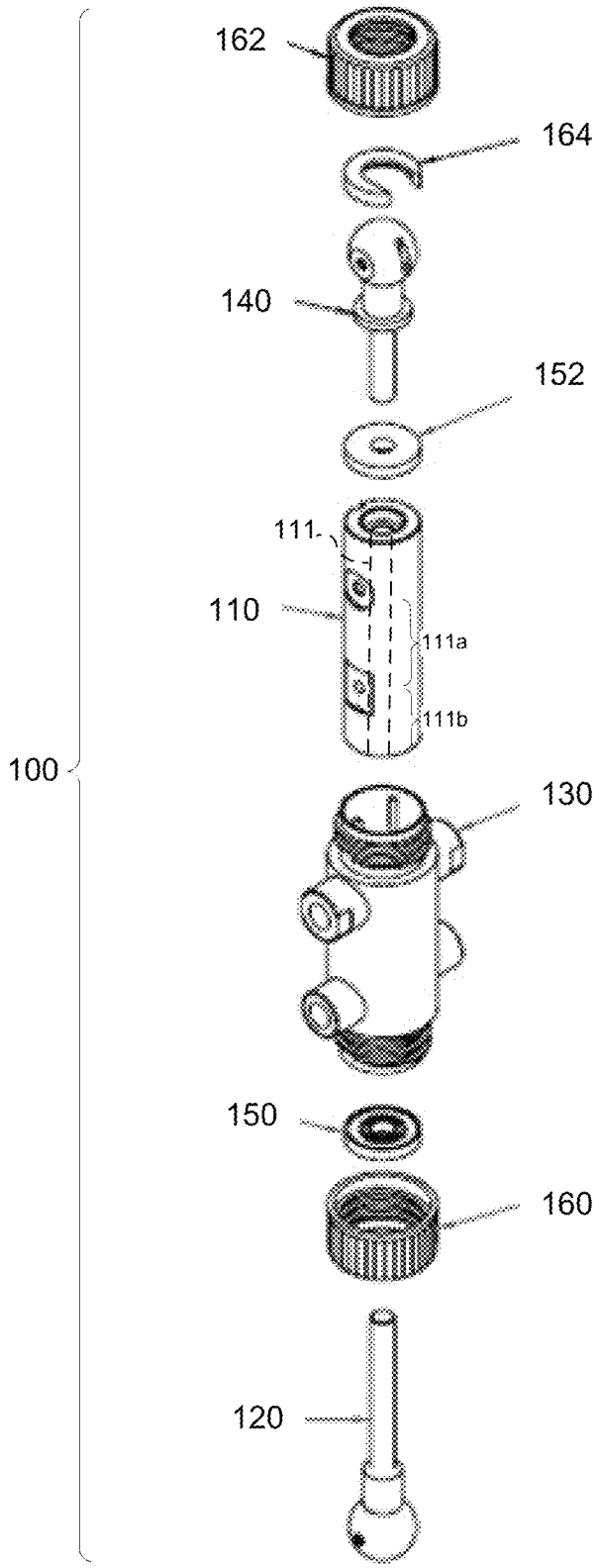
FIG. 4 is an exploded perspective view of the pump shown in FIGS. 1-3.
Figure 5:
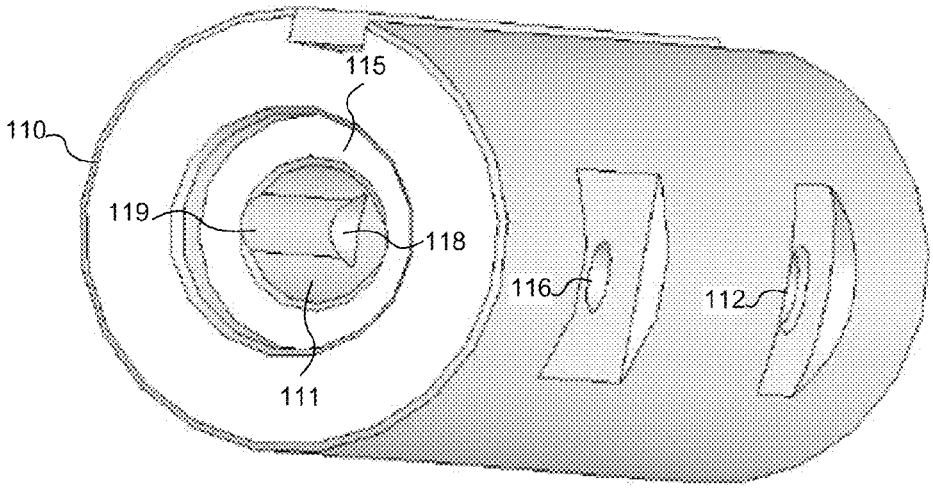
FIG. 5 is an enlarged view of the pump cylinder in the pump shown in FIGS. 1-4.
Figure 6:
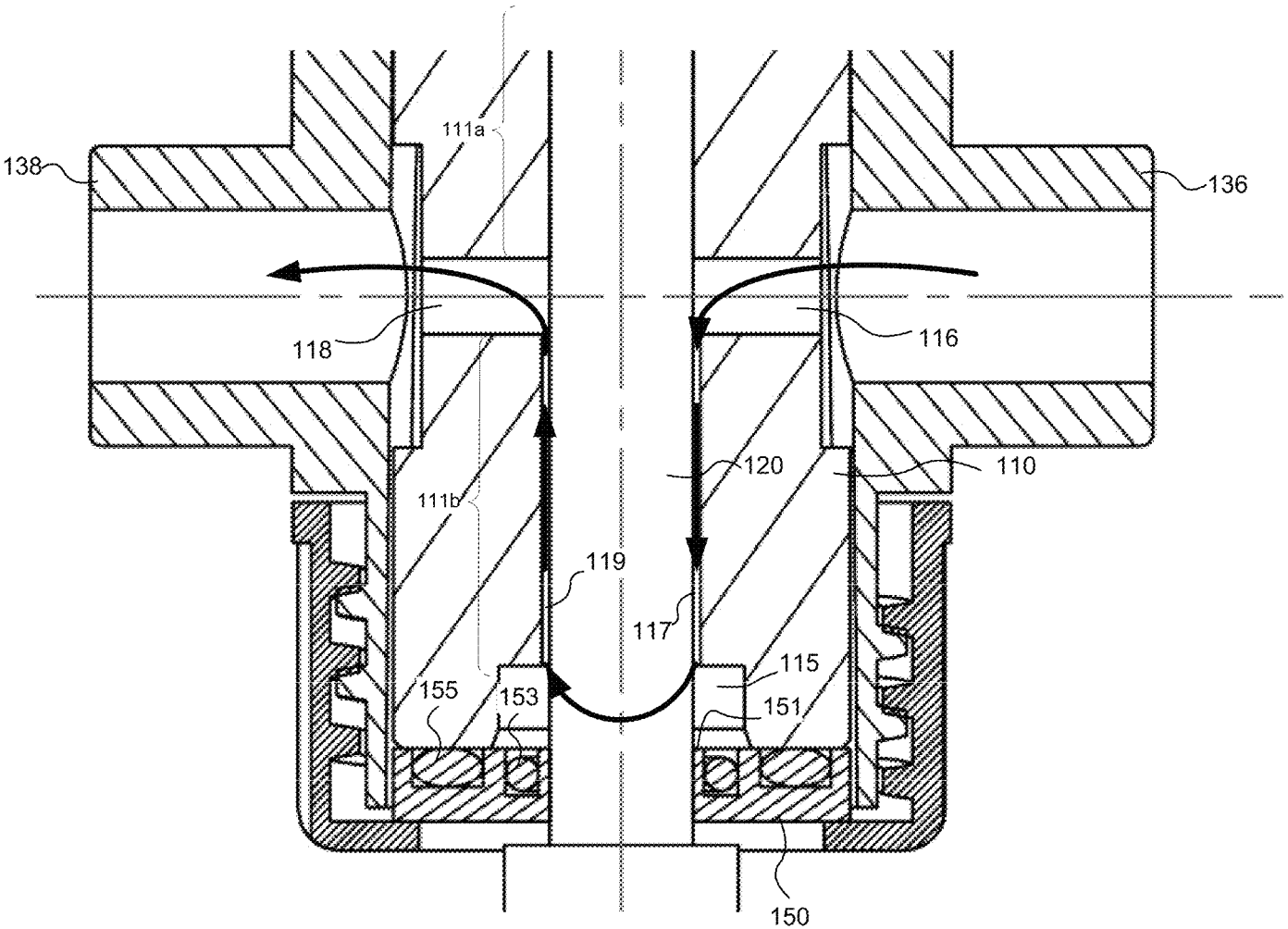
FIG. 6 is an enlarged cross-sectional view of a wash flow path through the pump shown in FIGS. 1-4.

Referring to FIGS. 1-6, one embodiment of a pump 100 is shown and described in greater detail. The pump 100 includes a pump cylinder 110 and a displacement piston 120, which both may be made of a ceramic material such as alumina or zirconia ceramic. The pump cylinder 110 defines a passageway 111 including a pump chamber section 111*a* and a piston wash section 111*b* (FIGS. 4 and 6). The passageway 111 of the cylinder 110 receives the displacement piston 120 such that the displacement piston 120 reciprocates within the passageway 111 to cause the liquid being pumped to be drawn into and expelled out of the pump chamber section 111*b*.

The piston 120 and the passageway 111 may have a relatively small diametrical clearance providing a tight fit, which acts as the primary seal of the pump chamber section 111*a* without requiring mechanical seals (e.g., O rings) between the piston 120 and the passageway 111. For example, the total diametrical clearance may be in a range of about 50 to 500 millionths of an inch and more specifically approximately 100 millionths of an inch. As used herein, "about" and "approximately" allow a variation within acceptable manufacturing tolerances.

The pump cylinder 110 also includes a liquid inlet 112, a liquid outlet 114, a wash inlet 116 and a wash outlet 118 in communication with the passageway 111. The liquid inlet 112 and liquid outlet 114 are located proximate a first end of the pump cylinder 110 and allow the liquid being pumped to enter and exit the pump chamber section 111*a* of the passageway 111. The wash inlet 116 and wash outlet 118 are located proximate a second end of the pump cylinder 110 and allow the wash liquid to enter and exit the liquid wash section 111*b* of the passageway 111. The pump cylinder 110 further includes first and second axial wash channels 117, 119 extending from the wash inlet 116 and the wash outlet 118, respectively, to a counterbore 115, thereby forming the wash flow path through the liquid wash section 111*b* (FIG. 6). The axial wash channels 117, 119 may be formed as rounded grooves having a radius less than the inner radius of the passageway 111 (see FIG. 5).

A lip seal 150 is located at the second end of the pump cylinder 110 and seals against the piston 120 to contain the wash liquid in the counterbore 115. The lip seal 150 may include a sealing lip 151 that engages and seals the piston 120 and a spring 153 that biases the lip seal 150 into engagement with the piston 120. The lip seal 150 may also include an O-ring 155 that seals against the end of the pump cylinder 110. The lip seal 150 may be made of a polyethylene or other suitable material.

The pump 100 may also include a pump case 130 around the pump cylinder 110. The pump case 130 includes a liquid inlet port 132, a liquid outlet port 134, a wash inlet port 136, and a wash outlet port 138 that correspond to and provide communication with the liquid inlet 112, the liquid outlet 114, the wash inlet 116, and the wash outlet 118, respectively.

The pump 100 may further include a valve piston 140 rotatably received in a valve section of the passageway 111 at a second end of the pump cylinder 110. The valve piston 140 may include a flat portion 144, channel or other similar feature, which allows the liquid to pass the valve piston 140 in to or out of the pump chamber section 111*a* of the passageway 111. In a first position, the valve piston 140 blocks the liquid outlet 114 and allows liquid to pass through the liquid inlet 112 into the pump chamber section 111*a* upon reciprocation of piston 120. In a second position, the valve piston 140 blocks the liquid inlet 112 and allows liquid to pass through the liquid outlet 114 out of the pump chamber section 111*a*.

A second lip seal 152 may be located at the second end to seal the valve piston 140. Threaded caps 160, 162 may be threaded at each end of the pump case 130 to retain the lip seals 150, 152 at the respective first and second ends of the pump cylinder 110. A valve retainer 164 may also be used to retain the piston valve 140.

The displacement piston 120 and the valve piston 140 may also include heads 122, 142 configured to engage an actuator (not shown). The pump 100 may be used, for example, with other pumps in a multiple pump system for precision liquid dispensing. Examples of such pumps are described in greater detail in U.S. Pat. Nos. 6,302,662 and 6,322,337.

In operation, the displacement piston 120 may be withdrawn with the flat portion 144 of the valve piston 140 located at the liquid inlet 112 such that the liquid is drawn in to the pump chamber section 111*a*. The valve piston 140 may then be rotated such that the flat portion 144 is located at the liquid outlet 114 and the displacement piston 120 may be pushed in to cause the liquid to be expelled from the pump chamber section 111*a* through the liquid outlet 114. These operations may be repeated to pump the liquid substantially continuously. While the displacement piston 120 is reciprocating to pump the liquid, a wash liquid, such as water or other suitable liquid, passes through the wash inlet 116, down the axial channel 117, around the counterbore 115, up the axial channel 119 and out the wash outlet 118 (FIG. 6). The wash liquid thus washes the piston 120 and a portion of the lip seal 150 engaging the piston 120. The axial wash channels 117, 119 increase exposure of a substantial length of the displacement piston 120 to the wash liquid for washing and cleaning. The counterbore 115 allows the entire circumference of the displacement piston 120 and the lip seal 150 to be washed and cleaned by the wash liquid.

Consistent with one aspect of the present disclosure, a pump includes a pump cylinder defining a passageway including a pump chamber section and a piston wash section. The pump cylinder includes a liquid inlet and a liquid outlet communicating with the pump chamber section proximate a first end of the pump cylinder and a wash inlet and a wash outlet communicating with the piston wash section proximate a second end of the pump cylinder. The pump cylinder further defines a counterbore at the second end of the pump cylinder and first and second axial wash channels extending from the wash inlet and the wash outlet, respectively, along the piston wash section to the counterbore. The pump also includes a displacement piston slidably received in the passageway at the second end of the pump cylinder. The displacement piston being slidable between the liquid inlet and outlet and the wash inlet and outlet to draw liquid in to and to push liquid out of the pump chamber section. The pump further includes a lip seal located at the second end of the pump cylinder for sealing against the displacement piston. The wash inlet, the wash outlet, the first and second axial wash channels, and the counterbore form a wash flow path that allows a wash liquid to wash the displacement piston.

Consistent with another aspect of the present disclosure, a method is provided for pumping a liquid solution having a tendency to precipitate solid particulate. The method includes: moving a valve piston between a first position allowing the liquid solution to pass in to a pump chamber section through a liquid inlet and a second piston allowing the liquid solution to pass out of the pump chamber section through a liquid outlet; reciprocating a displacement piston to draw the liquid solution through the liquid inlet and into the pump chamber section when the valve piston is located in the first position and to expel the liquid solution through the liquid outlet when the valve piston is located in the second position; and while the displacement piston is reciprocating, passing a wash liquid into a wash inlet, through a wash flow path around a circumference of the displacement piston, and out of a wash outlet.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A pump for pumping a liquid, the pump comprising:

a pump cylinder defining a passageway including a pump chamber section and a piston wash section, the pump cylinder including at least one liquid inlet and at least one liquid outlet communicating with the pump chamber section proximate a first end of the pump cylinder and a wash inlet and a wash outlet communicating with the piston wash section proximate a second end of the pump cylinder, the pump cylinder further defining a counterbore at the second end of the passageway and first and second axial wash channels extending from the wash inlet and the wash outlet, respectively, along opposite sides of the piston wash section to the counterbore;

a displacement piston slidably received in the passageway at the second end of the pump cylinder, the displacement piston being slidable between the liquid inlet and outlet and the wash inlet and outlet to draw liquid into and to push liquid out of the pump chamber section; and a lip seal located at the second end of the pump cylinder and sealing against the displacement piston, wherein the wash inlet, the wash outlet, the first and second axial wash channels, and the counterbore form a wash flow path through the piston wash section that extends to the lip seal and allows a wash liquid to wash in a first direction along a first length of the displacement piston, around a portion of the lip seal, and then in a second direction along a second length of the displacement piston on an opposite side of the piston, wherein the second direction is opposite the first direction.

2. The pump of claim 1, further comprising a valve piston rotatably received in the pump chamber at the first end of the pump cylinder, the valve piston being rotatable between at least first and second positions, wherein the valve piston allows liquid to flow into the pump chamber section through the liquid inlet in the first position, and wherein the valve piston allows liquid to flow out of pump chamber section through the liquid outlet in the second position.

3. The pump of claim 1, further comprising a valve piston received in the pump chamber at the first end of the pump cylinder, the valve piston being movable between at least first and second positions, wherein the valve piston allows liquid to flow into the pump chamber section through the liquid inlet in the first position, and wherein the valve piston allows liquid to flow out of pump chamber section through the liquid outlet in the second position.

4. The pump of claim 3 wherein the displacement piston and the valve piston include heads configured to engage actuators.

5. The pump of claim 1, wherein the displacement piston is received in the pump chamber section of the passageway with a relatively tight fit to seal the pump chamber section without mechanical seals.

6. The pump of claim 1, wherein the displacement piston is received in the pump chamber section of the passageway with a diametrical clearance in a range of 50 to 500 millionths of an inch.

7. The pump of claim 1, wherein the displacement piston is received in the passageway with a diametrical clearance of about 100 millionths of an inch.

8. The pump of claim 1, further comprising a pump case around the pump cylinder, the pump case including a liquid inlet port, a liquid outlet port, a wash inlet port, and a wash outlet port that correspond to and provide communication with the liquid inlet, the liquid outlet, the wash inlet, and the wash outlet, respectively.

9. The pump of claim 1, wherein the axial wash channels include rounded grooves having a radius less than an inner radius of the piston wash section of the passageway.

10. A method for pumping a liquid solution having a tendency to precipitate solid particulate, the method comprising:

moving a valve piston in a pump cylinder between a first position allowing the liquid solution to pass in to a pump chamber section through a liquid inlet and a second position allowing the liquid solution to pass out of the pump chamber section through a liquid outlet;

reciprocating a displacement piston in a passageway of the pump cylinder to draw the liquid solution through the liquid inlet and into the pump chamber section when the valve piston is located in the first position and to expel the liquid solution through the liquid outlet when the valve piston is located in the second position; and while the displacement piston is reciprocating, passing a wash liquid into a wash inlet, through a wash flow path around a circumference of the displacement piston, and out of a wash outlet, wherein the wash flow path includes axial wash channels extending from the wash inlet and the wash outlet to a counterbore in the pump cylinder, wherein the wash liquid passes from the wash inlet axially in a first direction along a piston wash section of the passageway and the displacement piston, passes across at least a portion of a lip seal sealing against the displacement piston, and then passes axially in a second direction along an opposite side of the piston wash section and the displacement piston to the wash outlet, wherein the second direction is opposite the first direction.

11. The method of claim 10, wherein the liquid solution includes a salt solution that precipitates salt crystals.

12. The method of claim 10, wherein moving the valve piston between the first and second positions includes rotating the valve piston.

* * * * *